US006981852B2

(12) United States Patent
Anderson

(10) Patent No.: US 6,981,852 B2
(45) Date of Patent: Jan. 3, 2006

(54) STRAINER AND VALVE RELEASE

(75) Inventor: Steven A. Anderson, Eden Prairie, MN (US)

(73) Assignee: Wagner Spray Tech Corporation, Plymouth, MN (US)

( * ) Notice: Subject to any disclaimer, the term of this patent is extended or adjusted under 35 U.S.C. 154(b) by 225 days.

(21) Appl. No.: 10/427,446

(22) Filed: May 1, 2003

(65) Prior Publication Data

US 2004/0219027 A1 Nov. 4, 2004

(51) Int. Cl.
*F04B 23/00* (2006.01)
*F04B 7/00* (2006.01)

(52) U.S. Cl. ..... 417/313; 417/446; 137/522; 137/550

(58) Field of Classification Search ..... 417/313, 417/446; 137/522, 523, 550; 251/82, 83
See application file for complete search history.

(56) References Cited

U.S. PATENT DOCUMENTS 2,164,911 A * 7/1939 Garverick ..... 137/636
2,642,261 A * 6/1953 Gates ..... 251/322
5,067,518 A * 11/1991 Kosmyna ..... 137/588
5,526,843 A * 6/1996 Wolf et al. ..... 137/550

* cited by examiner

*Primary Examiner*—Charles G. Freay
(74) *Attorney, Agent, or Firm*—Faegre & Benson LLP

(57) ABSTRACT

A combined strainer and valve release structure formed as a unitary part of polyethylene with the strainer having a perforated wall and the valve release having a pushrod located on one side of the wall and an actuator tab located on the other side of the wall, with the pushrod in proximity to a movable member of an inlet check valve in a rest position and manually movable to an actuated position to dislodge the movable member when the movable member is adhered to a valve seat in the inlet check valve. The strainer moves the pushrod to the rest position when released from manual actuation.

17 Claims, 9 Drawing Sheets

STRAINER AND VALVE RELEASE

CROSS REFERENCE TO RELATED APPLICATIONS

Reference is made to the following copending and commonly assigned U.S. Patent Applications by the same inventors, each of which was filed on the same day as the instant application, and each of which is hereby expressly incorporated by reference:

i) IMPROVED SWASHPLATE PUMP, Ser. No. 10/427,447; and ii) FAN BAFFLE, Ser. No. 10/427,448.

FIELD OF THE INVENTION

This invention relates to the field of pumps for paint and related coating materials.

BACKGROUND OF THE INVENTION

In the past, it has been known to provide strainers for preventing foreign solids over a certain size from being ingested into a paint pump. It has further been known to provide a mechanism for releasing a moveable element in an inlet check valve of a paint pump which has become stuck in a closed position due to inadequate cleaning.

Heretofore, however, there has not been an apparatus that has combined the features and functions of a strainer with a valve release. The present invention provides such a combination with attendant reduction in the complexity and cost associated with the prior art approach of using separate parts to perform the separate functions.

DETAILED DESCRIPTION

Figure 1:
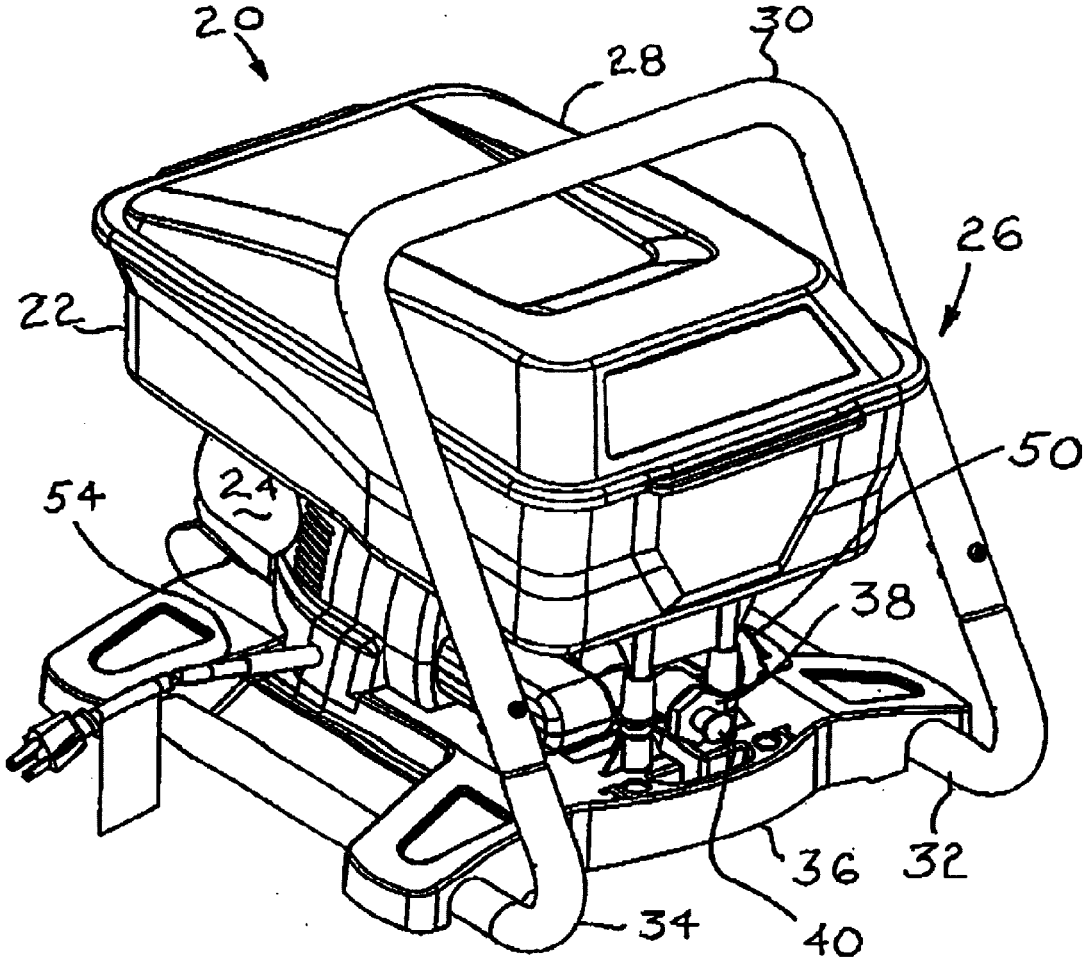
FIG. 1 is a perspective view of a paint pump apparatus useful in the practice of the present invention.
Figure 2:
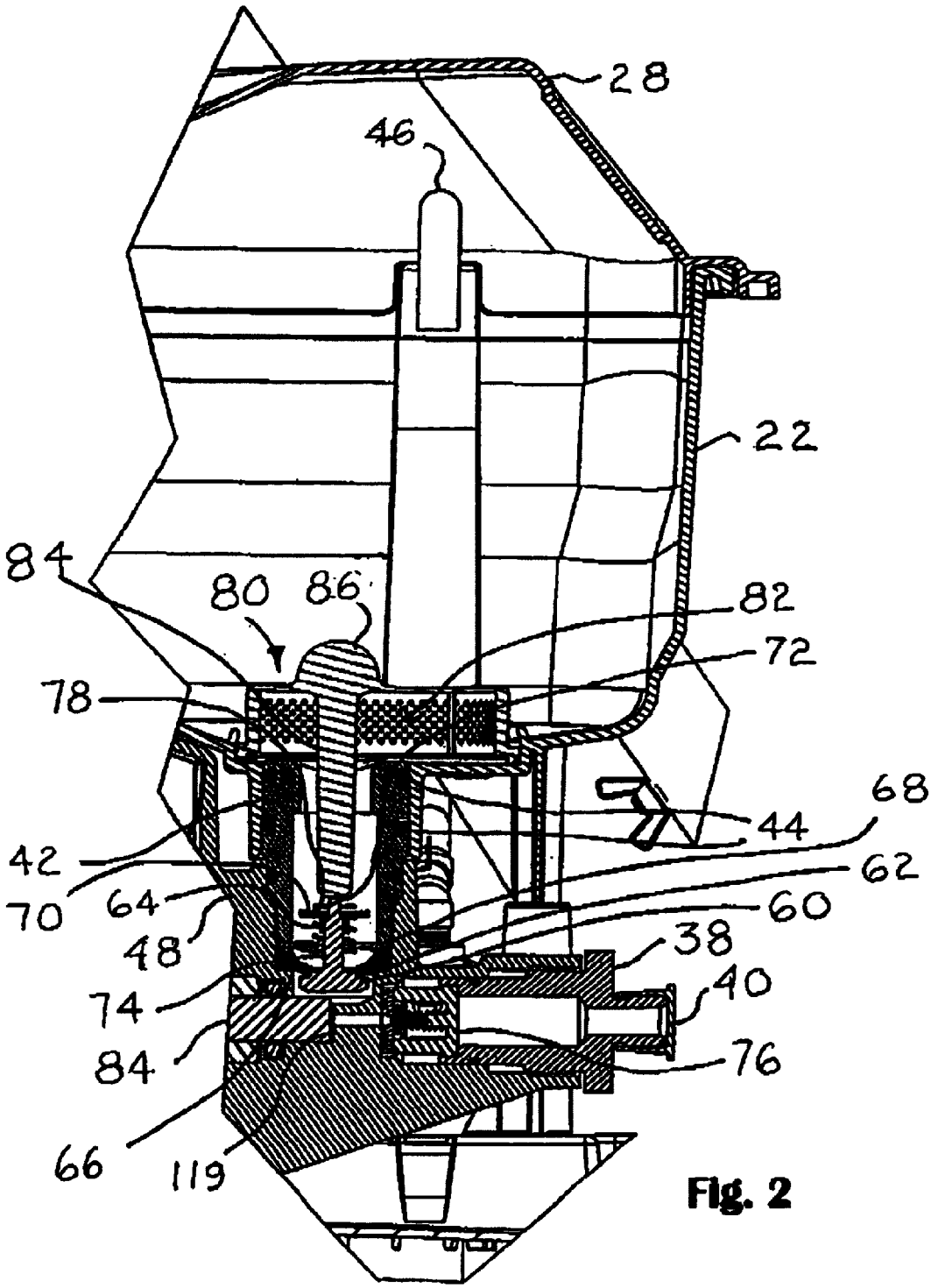
FIG. 2 is a fragmentary cutaway view, partly in section, of a portion of the apparatus of FIG. 1.
Figure 3:
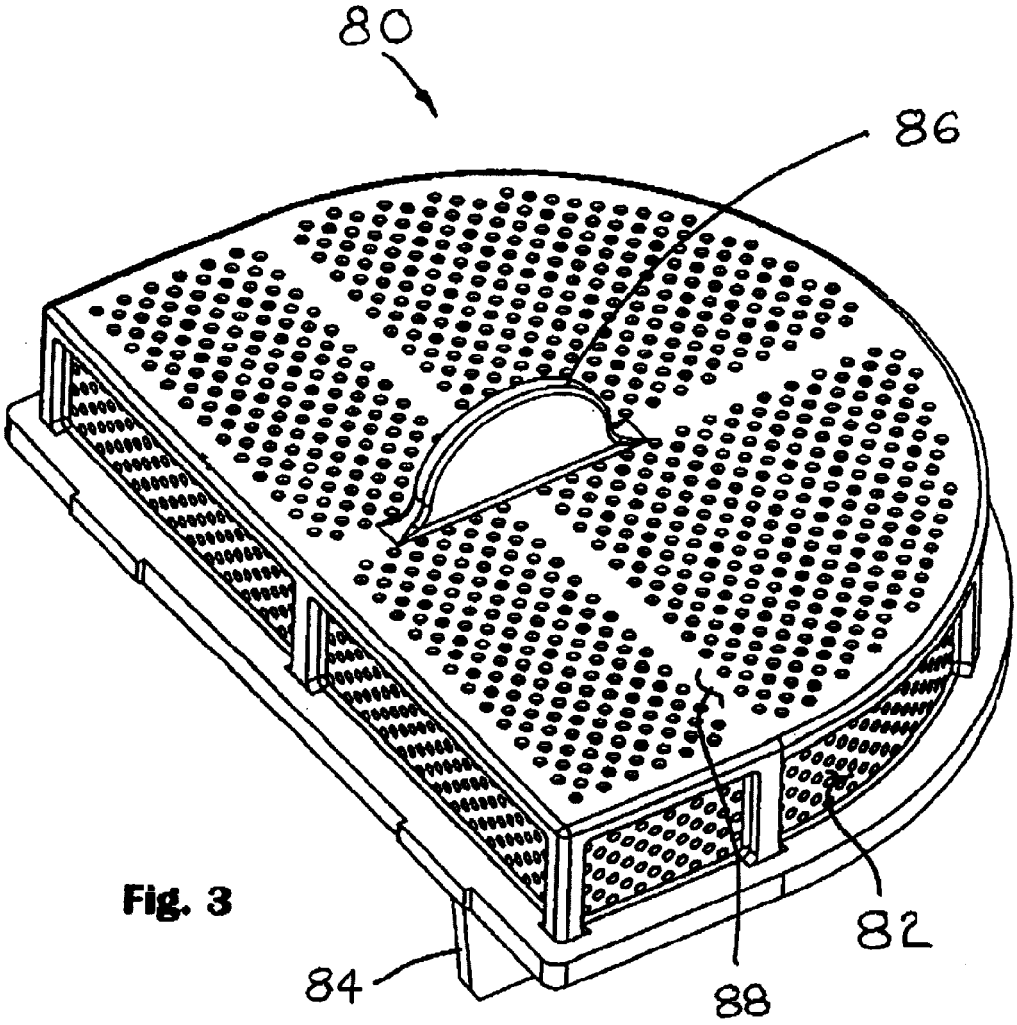
FIG. 3 is a perspective view of a combined strainer and valve release part useful in the practice of the present invention.
Figure 4:
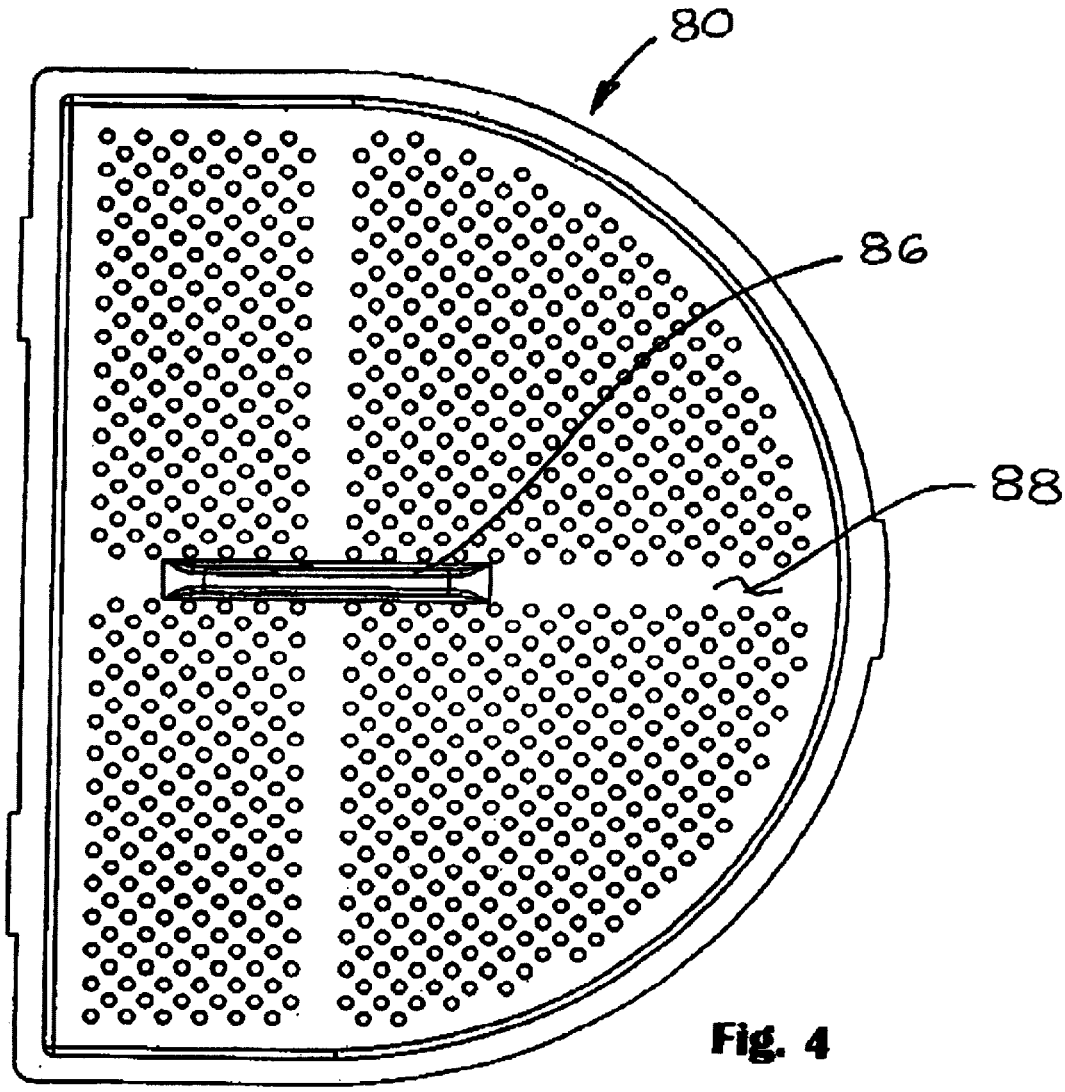
FIG. 4 is a top plan view of the combined strainer and valve release part of FIG. 3.
Figure 5:
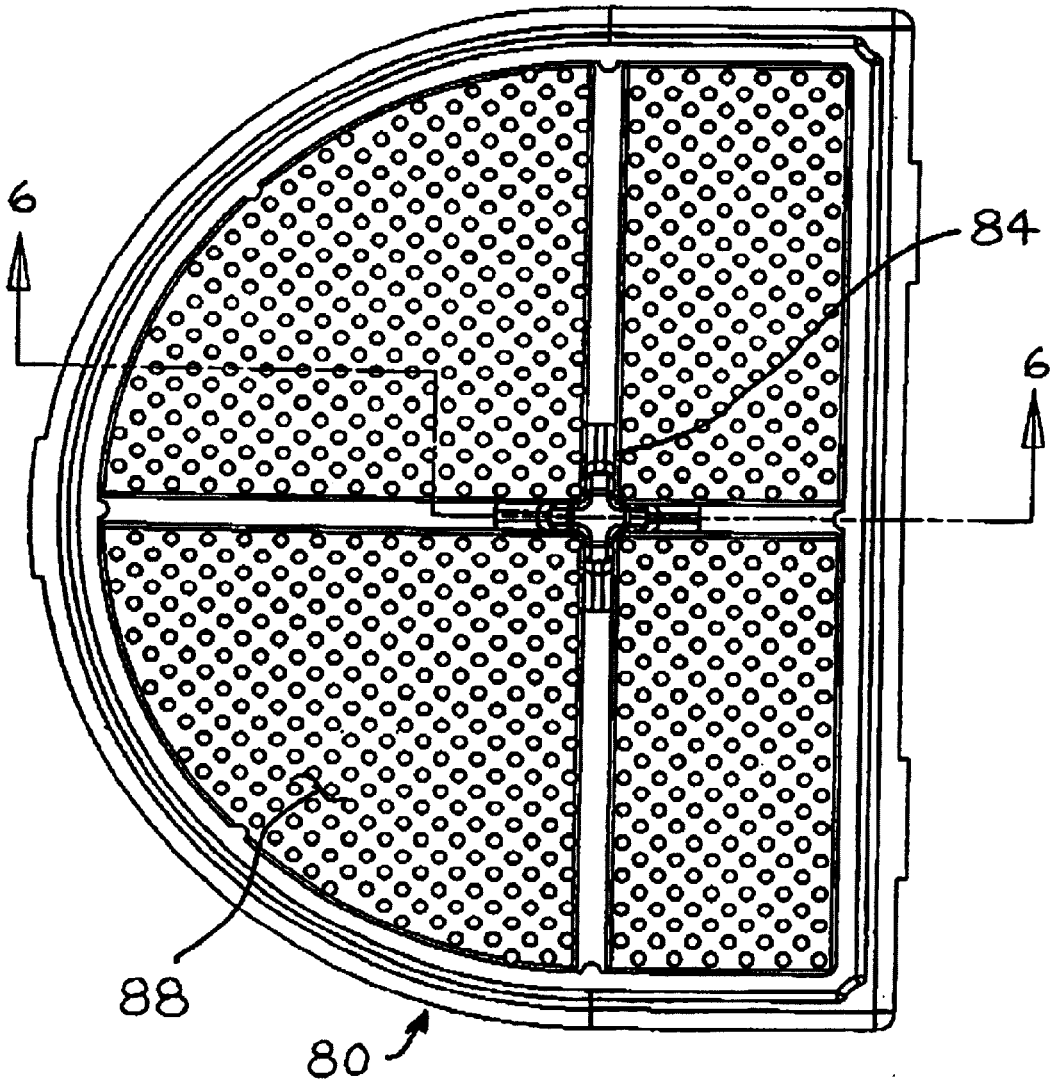
FIG. 5 is a bottom plan view of the combined strainer and valve release part of FIG. 3.
Figure 6:
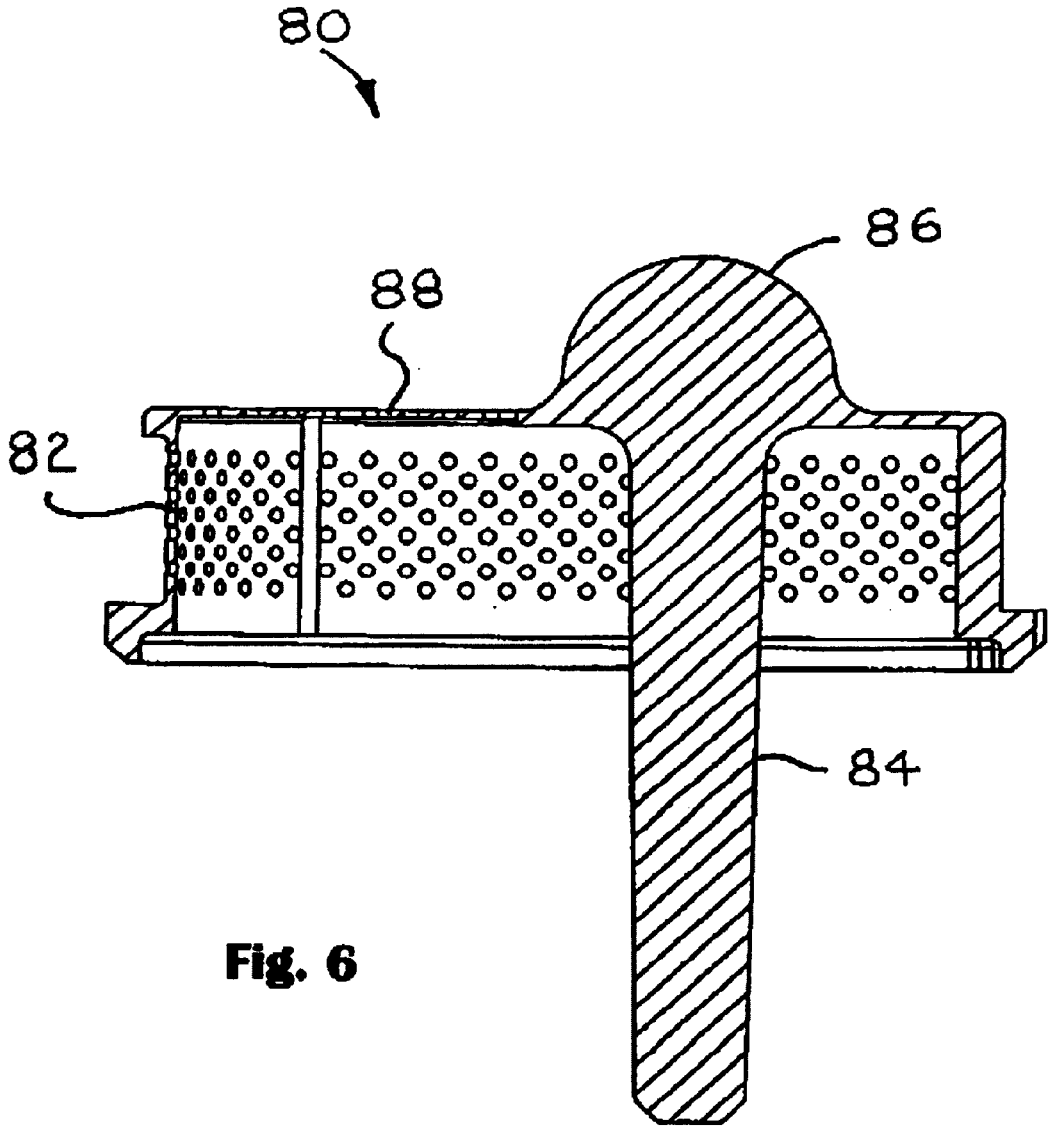
FIG. 6 is a side section view along line 6—6 of FIG. 5.

Referring to the Figures, and most particularly to FIGS. 1 and 2, a paint pump apparatus 20 useful in the practice of the present invention may be seen. Apparatus 20 is intended to pump paint and similar coatings at high pressure to a spray gun (not shown) for application to a surface to be coated via airless spraying.

Apparatus 20 includes a paint reservoir 22 and a pump assembly 24 carried by a frame 26. Reservoir 22 may have a cover 28. Frame 26 preferably has a handle portion 30 and a pair of foot portions 32, 34. Foot portions 32 and 34 are received in a base 36 which supports pump assembly 24. It is to be understood that a high pressure hose (not shown) is connected to an outlet 38 of the pump assembly 24 after a cap 40 is removed. The high pressure hose is also connected to an airless spray gun (not shown) for delivering paint or other coating material to a surface (not shown) desired to be coated. An inlet 42 of the pump assembly 24 is in fluid communication with reservoir 22, and sealed against leakage therebetween by one or more O-rings 44. It is to be understood that paint (or other similar coating material) is delivered by gravity from reservoir 22 to inlet 42 of the paint pump assembly 24. As is conventional, a return tube 46 is provided from a pump and valve housing 48 containing inlet 42 and outlet 38. Return tube 46 will return paint from the pump to the reservoir during a "priming" mode. A mechanical switch 50 enables transfer from the "priming" mode to a "run" mode wherein paint is delivered to the outlet 38 instead of the return tube 46. An ON-OFF electrical switch (not shown) enables power from a power cord 54 (when connected to electrical supply, not shown) to be delivered to an electric motor (not shown). The motor or another form of prime mover, such as a gasoline engine (also not shown) provides mechanical power for pump assembly 24 which includes a piston 84 axially reciprocating in a cylinder or pumping chamber 119. An inlet check valve 74 is positioned in inlet 42. Similarly an outlet check valve 76 is positioned in outlet 38.

The inlet check valve has a valve member in the form of an inlet poppet 60 carrying an O-ring 62 and urged by a spring 64 to seal against an inlet seat 66. An inlet seat lid 68 supports the inlet poppet 60 and spring 64. Spring 64 is retained by a spring stop 70 which is preferably secured to a stem 72 of the inlet poppet by a pushnut 78 or by thermally fusing the stem 72 to the stop 70.

Referring now to FIGS. 3–6 and 8, a strainer and valve release part 80 is preferably made in the form of a single molded part preferably formed entirely of polyethylene. Part 80 preferably has a screen side wall 82, a pushrod 84, an actuator tab 86, and a screen top wall 88. The side wall 82 and top wall 88 are preferably about 0.090 inches thick and preferably each have a perforation pattern of through holes 90 to provide the function of a strainer. When the part 80 is installed as shown in FIG. 2, actuator tab 86 may be depressed to move the pushrod 84 against the stem 72 of the inlet check valve 74, to break any adhesion of the inlet poppet 60 or O-ring 62 with seat 66, as, for example that which may occur when valve 74 is incompletely cleaned. In addition to functioning as a strainer, the top wall 88 of part 80 also acts both as a support for pushrod 84 and tab 86, and further acts as a return spring for pushrod 84 to move pushrod 84 away from the stem 72 of the inlet check valve 74 when the tab 86 is released, to avoid interference with the normal operation of valve 74. In the embodiment shown, the pushrod 84 extends 2⅛ inches below the bottom surface of top wall 88; however, it is to be understood that the pushrod 84 is preferably designed to extend to be close to, but not touch the top of stem 72, when the valve 74 is closed, and the part 80 is in its rest or "relaxed" or unactivated state. Tab 86 in the embodiment shown extends 7⁄16 inch above the upper surface of top wall 88; however, it is to be understood that tab 86 may be sized and shaped as desired, to direct a user to depress the top wall 88 of part 80 preferably immediately above pushrod 84, for most efficient and convenient operation of the valve release function of part 80.

Figure 7:
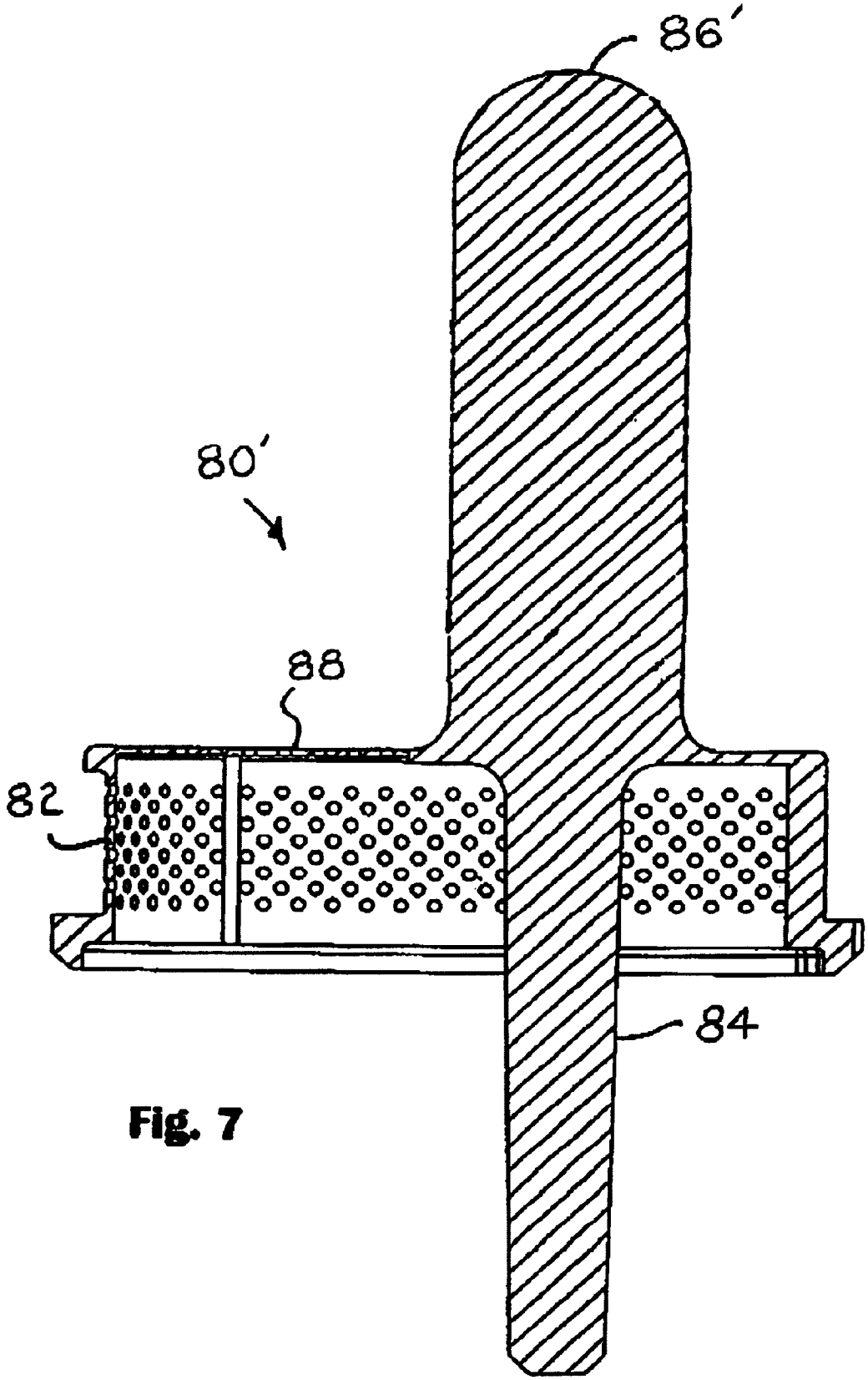
FIG. 7 is a side section view similar to that of FIG. 6, except showing an alternative embodiment for the combined strainer and valve release part of the present invention.

Referring now to FIG. 7, an alternative embodiment of strainer and release part 80' may be seen in which the actuator tab 86' is elongated. With this embodiment, the tab 86' may be sized to project up sufficiently high so that when reservoir 22 is filled with paint, the tab 86' projects above the top surface of the paint in the reservoir, enabling a user to actuate the pushrod 84 without having to reach below the top surface of the paint.

Figure 8:
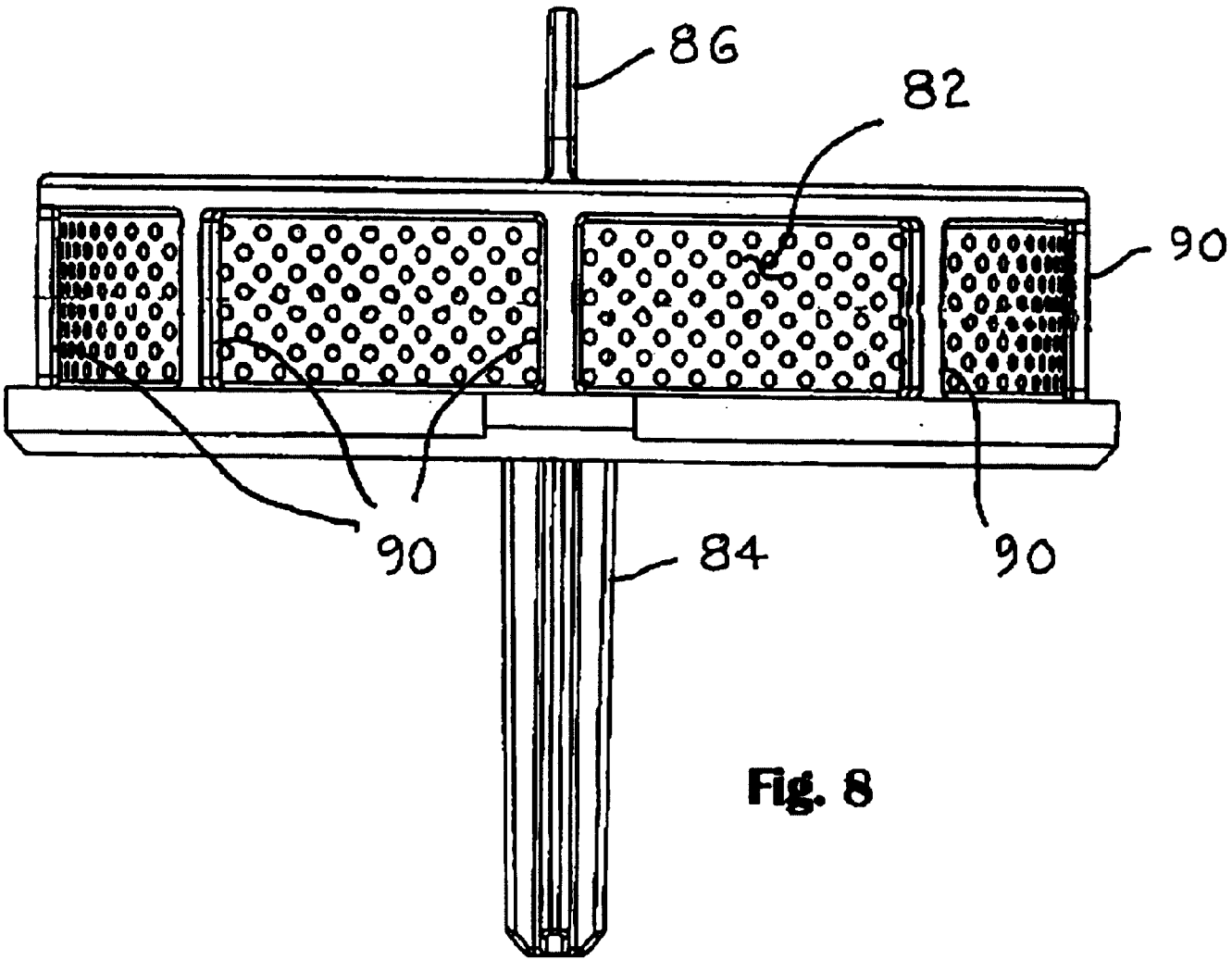
FIG. 8 is a side elevation view of the combined strainer and valve release part of FIG. 3.

A side view of the strainer and release part 80 may be seen in FIG. 8. A plurality of stiffening ribs or pillars 90 may be provided to add strength and rigidity to the part 80.

Figure 9:
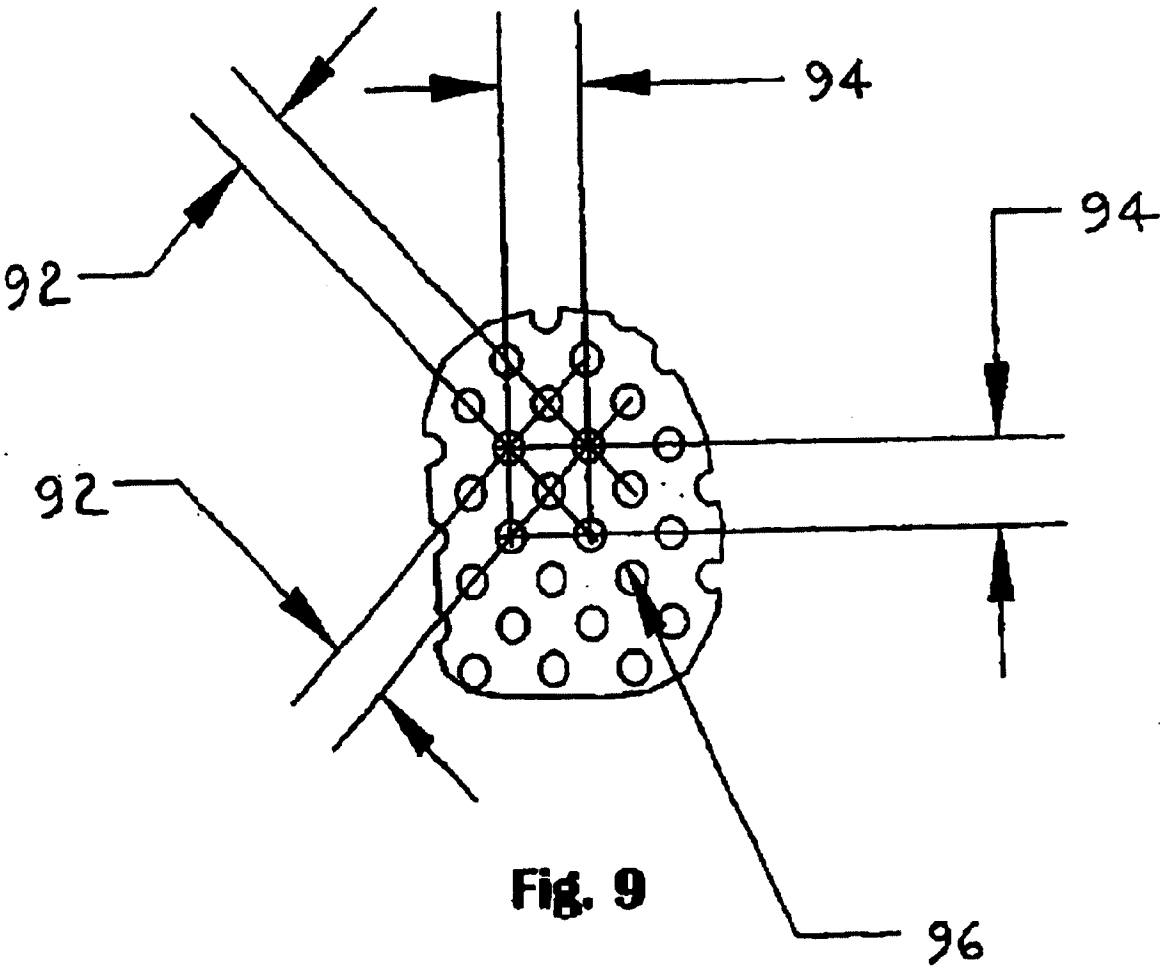
FIG. 9 is an enlarged fragmentary view of a portion of the combined strainer and valve release part of FIG. 4 illustrating a preferred hole pattern for the strainer.

Referring now also to FIG. 9, a preferred hole pattern for part 80 may be seen. In the embodiment shown, a diagonal hole-to-hole dimension 92 is preferably 0.078 inches, and a "square" hole-to-hole dimension 94 is preferably 0.110 inches, with a hole diameter 96 of 0.040 inches. It is to be understood that these dimensions may be varied while still remaining within the scope of the present invention defined by the claims.

The combined strainer and valve release of the present invention may thus be seen to be a strainer positionable with respect to the inlet check valve and having at least one surface with apertures therethrough to permit flow of liquid to the check valve and to prevent movement of solids larger than the apertures from passing through the surface to the check valve; and a pushrod connected to the strainer and located in a rest position adjacent a movable member of the check valve wherein the pushrod is movable to an actuated position to displace the movable member wherein at least a portion of the strainer returns the pushrod from the actuated position to the rest position when the pushrod is released from the actuated position. The portion of strainer that returns the pushrod is made up of a resilient surface of the strainer. The strainer includes a perforated enclosure with a portion of the strainer having deformable resiliency to allow movement of the pushrod from the rest position to the actuated position. An actuator tab connected to the strainer for moving the pushrod from the rest position to the actuated position, with the actuator tab preferably aligned with the pushrod and the perforated wall interposed between the actuator tab and the pushrod and wherein the perforated wall is the portion of the strainer that returns the pushrod to the rest position when the pushrod is released from the actuated position. Preferably, at least a portion of the perforated wall is disposed generally perpendicularly to the pushrod. The actuator tab extends a predetermined distance away from the perforated wall. In the embodiment shown, the strainer and pushrod are formed as a molded part made of generally homogeneous polyethylene material.

In another aspect, the present invention may be seen to be a combined paint pump inlet check valve and unitary strainer and valve release structure wherein the inlet check valve has a movable member and the unitary strainer and valve release structure including a strainer located at an inlet of the inlet check valve; and a pushrod formed integrally with the strainer and extending to a location adjacent the movable member of the inlet check valve in a rest position and displaceable to an actuated position wherein the pushrod displaces the movable member of the inlet check valve wherein the strainer has a resilient portion which returns the pushrod from the actuated position to the rest position when the pushrod is released. The strainer has a perforated wall and the pushrod is mounted on the perforated wall and integrally formed of the same polyethylene material.

In still another aspect, the present invention includes a method of releasing a stuck inlet check valve in a paint pump comprising the steps of locating a combined strainer and valve release structure at an inlet of an inlet check valve of a paint pump wherein the strainer has a pushrod extending to a rest position adjacent a movable member of the inlet check valve; manually displacing the pushrod from the rest position to an actuated position by pressing on the strainer to dislodge the movable member of the inlet check valve from a valve seat in the inlet check valve; and manually releasing the strainer and causing the strainer to return the pushrod to the rest position. In practicing this method, the strainer and valve release structure may include an actuator tab. The step of manually displacing the pushrod may include manually urging the actuator tab to press on the strainer.

The invention is not to be taken as limited to all the details thereof as modifications and variations thereof may be made without departing from the spirit or scope of the invention.

What is claimed is:

1. A combined strainer and valve release structure for a paint pump apparatus wherein the pump apparatus includes an inlet check valve, the combined strainer and valve release structure comprising:

a) a strainer positionable with respect to the inlet check valve and having at least one surface with apertures therethrough to permit flow of liquid to the check valve and to prevent movement of solids larger than the apertures from passing through the surface to the check valve; and b) a pushrod connected to the strainer and located in a rest position adjacent a movable member of the check valve wherein the pushrod is movable to an actuated position to displace the movable member wherein at least a portion of the strainer returns the pushrod from the actuated position to the rest position when the pushrod is released from the actuated position.

2. The structure of claim 1 wherein the portion of strainer that returns the pushrod comprises a resilient surface of the strainer.

3. The structure of claim 1 wherein the strainer further comprises a perforated enclosure.

4. The structure of claim 1 wherein the portion of the strainer has deformable resiliency to allow movement of the pushrod from the rest position to the actuated position.

5. The structure of claim 1 further comprising:

c) an actuator tab connected to the strainer for moving the pushrod from the rest position to the actuated position.

6. The structure of claim 5 wherein the actuator tab is aligned with the pushrod.

7. The structure of claim 6 wherein the strainer has a perforated wall interposed between the actuator tab and the pushrod.

8. The structure of claim 7 wherein the perforated wall is the portion of the strainer that returns the pushrod to the rest position when the pushrod is released from the actuated position.

9. The structure of claim 7 wherein at least a portion of the perforated wall is disposed generally perpendicularly to the pushrod.

10. The structure of claim 7 wherein the actuator tab extends a predetermined distance away from the perforated wall.

11. The structure of claim 1 wherein the strainer and pushrod are formed as a molded part made of generally homogeneous material.

12. The structure of claim 11 wherein the material is polyethylene.

13. A combined paint pump inlet check valve and unitary strainer and valve release structure wherein the inlet check valve has a movable member and the unitary strainer and valve release structure comprises:

a) a strainer located at an inlet of the inlet check valve; and b) a pushrod formed integrally with the strainer and extending to a location adjacent the movable member of the inlet check valve in a rest position and displaceable to an actuated position wherein the pushrod displaces the movable member of the inlet check valve wherein the strainer has a resilient portion which returns the pushrod from the actuated position to the rest position when the pushrod is released.

14. The combination of claim 13 wherein the strainer has a perforated wall and the pushrod is mounted on the perforated wall and integrally formed of the same material therewith.

15. The combination of claim 14 wherein the material is polyethylene.

16. A method of releasing a stuck inlet check valve in a paint pump comprising the steps of:

a) locating a combined strainer and valve release structure at an inlet of an inlet check valve of a paint pump wherein the strainer has a pushrod extending to a rest position adjacent a movable member of the inlet check valve;

b) manually displacing the pushrod from the rest position to an actuated position by pressing on the strainer to dislodge the movable member of the inlet check valve from a valve seat in the inlet check valve; and c) manually releasing the strainer and causing the strainer to return the pushrod to the rest position.

17. The method of claim 16 wherein the strainer and valve release structure includes an actuator tab and the step of manually displacing the pushrod further comprises manually urging the actuator tab to press on the strainer.

* * * * *